US010570682B2

(12) United States Patent
Sand et al.

(10) Patent No.: US 10,570,682 B2
(45) Date of Patent: Feb. 25, 2020

(54) MODULAR SYSTEM AND METHOD FOR CONTROLLING SUBSEA OPERATIONS

(71) Applicant: FMC Kongsberg Subsea AS, Kongsberg (NO)

(72) Inventors: Frode Sand, Drammen (NO); Ole Thomas Enge, Sandefjord (NO); Idar Lindanger, Nesttun (NO); Inge Magne Sekkingstad, Sandsli (NO); Stein Slettum, Vestfossen (NO); Thomas Dypevik, Kolltveit (NO); Helge Drønen, Kolbeinsvik (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 15/561,517

(22) PCT Filed: Mar. 17, 2016

(86) PCT No.: PCT/EP2016/055805
§ 371 (c)(1),
(2) Date: Sep. 25, 2017

(87) PCT Pub. No.: WO2016/150811
PCT Pub. Date: Sep. 29, 2016

(65) Prior Publication Data

US 2018/0066485 A1 Mar. 8, 2018

(30) Foreign Application Priority Data

Mar. 24, 2015 (NO) ..... 20150356
Sep. 16, 2015 (NO) ..... 20151200

(51) Int. Cl.
*E21B 21/08* (2006.01)
*E21B 33/035* (2006.01)
*E21B 7/12* (2006.01)

(52) U.S. Cl.
CPC ..... *E21B 21/08* (2013.01); *E21B 7/12* (2013.01); *E21B 33/0355* (2013.01)

(58) Field of Classification Search
CPC ..... E21B 33/0355
See application file for complete search history.

(56) References Cited

U.S. PATENT DOCUMENTS 3,894,560 A * 7/1975 Baugh ..... E21B 33/0355 137/236.1
4,502,407 A * 3/1985 Stevens ..... E02B 17/0034 114/222

(Continued)

FOREIGN PATENT DOCUMENTS

GB 2 338 971 A 1/2000

OTHER PUBLICATIONS

S.A. Technologies, PTE Ltd., "Wellhead Control System—EH36 Series", Product brochure (2011).

*Primary Examiner* — Matthew R Buck
*Assistant Examiner* — Aaron L Lembo

(57) ABSTRACT

The invention concerns a modular system for controlling subsea operations. The modular system comprises a control room structure at a top side location, the control room structure is provided with a fixed modular connection assembly. The interior of the control room structure is prepared for accommodation f a set of replaceable control modules comprising at least one dedicated control module provided for controlling a corresponding operational well tool. The said set of replaceable control module(s) is selected in accordance with a chosen subsea operation for accommodation in the control room structure. The said set of replaceable control module(s) accommodated in the control room structure is connected to the fixed modular connection assembly for establishing communication between the at least one dedicated control module and its corresponding (Continued)

operational well tool. The invention also concerns a method for controlling subsea operations.

8 Claims, 5 Drawing Sheets

(56) References Cited

U.S. PATENT DOCUMENTS 4,666,340 A * 5/1987 Cox ..... E02B 17/00 166/340
4,732,103 A * 3/1988 Culbertson ..... B63B 29/02 114/65 R
5,438,713 A * 8/1995 Clarke ..... B63B 29/14 4/640
6,223,669 B1 * 5/2001 Bowden ..... B63B 3/04 114/65 R
6,644,410 B1 11/2003 Lindsey-Curran et al.
6,775,137 B2 * 8/2004 Chu ..... H05K 7/20754 165/120
7,669,541 B2 * 3/2010 Horton, III ..... B63B 35/38 114/266
8,122,965 B2 * 2/2012 Horton, III ..... B63B 35/003 166/336
8,720,379 B2 * 5/2014 Moreno ..... A01K 1/0058 119/454
8,947,879 B2 * 2/2015 Broome ..... H05K 7/1497 165/104.33
9,103,204 B2 * 8/2015 Yates ..... E21B 47/18
9,762,864 B2 * 9/2017 Norland ..... H04N 7/18
9,966,739 B2 * 5/2018 Chen ..... E04H 5/00
2007/0000419 A1 * 1/2007 Millheim ..... B63C 1/02 114/44
2008/0055846 A1 * 3/2008 Clidaras ..... G06F 1/20 361/679.41
2008/0250726 A1 * 10/2008 Slagel ..... E04H 1/1205 52/79.8
2008/0264649 A1 * 10/2008 Crawford ..... E21B 19/22 166/381
2010/0089589 A1 * 4/2010 Crawford ..... E21B 44/00 166/379
2010/0091449 A1 * 4/2010 Clidaras ..... G06F 1/20 361/679.49
2011/0011314 A1 * 1/2011 Slagel ..... E04H 1/1205 109/23
2012/0019115 A1 * 1/2012 Dunwoody ..... H05K 7/1488 312/236
2012/0060411 A1 * 3/2012 Morris ..... C11C 3/003 44/388
2012/0255921 A1 * 10/2012 Franklin-Lees ..... H05K 7/1488 211/26
2014/0160235 A1 * 6/2014 Norland ..... H04N 7/18 348/37
2015/0145391 A1 * 5/2015 Broome ..... H05K 7/1497 312/236
2015/0204754 A1 * 7/2015 Henderson ..... G01M 3/2846 73/40
2016/0212891 A1 * 7/2016 Morimoto ..... H05K 9/0069
2016/0227665 A1 * 8/2016 Norwood ..... G06F 17/50
2017/0349455 A1 * 12/2017 Katz ..... B01D 61/022

* cited by examiner

MODULAR SYSTEM AND METHOD FOR CONTROLLING SUBSEA OPERATIONS

FIELD OF THE INVENTION

The invention concerns a modular system for controlling subsea operations and a method for controlling subsea operations and subsea related operations. The invention may be suitable for controlling a number of subsea operations, but may be found particularly applicable for controlling work over operations.

BACKGROUND OF THE INVENTION

Existing systems for controlling subsea operations, such as for instance systems for work over operations, are provided as complex systems that are made up of large-sized control equipment specialized for each operation to be carried out. The design of these control systems requires a specific makeup for carrying out each of the various work over operations, and when switching from one work over operation to another this necessitates replacement of control units. These prior art control units are large and cumbersome and require lifting equipment that must be employed in accordance with a set of handling regulations and restrictions.

Further, the complexity of the existing control systems necessitates the attendance of an operator with qualified skills for the repair and/or maintenance of the control system. The requirement for bringing in specialized personnel offshore results in a subsequent time delay to the running of the system.

However, given the increasing demands from operators within the oil and gas industry to reduce costs and provide solutions that are more time efficient, a need has arisen to provide solutions that do not involve elaborate and time consuming operations.

The problem to be solved by the invention resides in how to provide low cost, efficient solutions that are capable of reducing the handling time while still meeting the requirements for quality when performing the tasks of the gas or oil operator.

SUMMARY OF THE INVENTION

Based on the need as exemplified above, an object of the present invention is to provide a modularized solution for controlling equipment and tools to be used in subsea operations.

A modular system for controlling subsea operations is provided in accordance with the independent claim, and the dependent claims define advantageous embodiments of the modular system as defined in the independent claim. Further, a method for controlling subsea operations is defined in accordance with the independent method claim.

The modular system for controlling subsea operations in accordance with the invention comprises a control room structure located top side/close to the surface, for instance on board a rig or a vessel for carrying out subsea operations. The vessel or rig is usually situated at or near the sea surface where access to the control room structure is fairly easy and unobstructed.

The control room structure is provided with a fixed modular connection assembly and is also prepared for accommodation of a set of replaceable control modules. The set of replaceable control modules comprises at least one dedicated control module provided for controlling a corresponding operational well tool. As the modular system is prepared for controlling various subsea operations, the said set of replaceable control module(s) is selected in accordance with a chosen subsea operation, and the replaceable control module(s) are accommodated in the control room structure. The set of replaceable control module(s) accommodated in the control room structure is connected to the fixed modular connection assembly for establishing communication between the at least one dedicated control module and its corresponding operational well tool.

The fixed modular connection assembly may comprise a hydraulic module and may be arranged for receiving signals from the replaceable control modules and transferring the signals as pressure signals to the operational well tool. To facilitate the implementation of the modular system into the existing infrastructure commonly available when carrying out specific subsea operations, the fixed modular connection assembly may be provided with at least one connection member with a standardized interface for receiving a connector of at least one line that communicates with the operational well tool(s).

The set of the replaceable control modules may be accommodated in the control room structure in various ways to facilitate easy depositing and retrieval of the replaceable control modules, and also to ensure that the control modules are accommodated safely. In one embodiment the control room structure may be arranged with a compartment unit having storage space for the set of replaceable control modules. The unit may be movably arranged in the interior of the control room structure.

The compartment unit may be movably arranged between a storage position wherein at least a portion of the compartment unit is positioned inside the control room structure and an access position wherein outside access to the compartment unit is provided. By this arrangement of the compartment unit, the replaceable control modules are safely accommodated in the control room compartment when in the storage position, whereas access is granted to the storage rooms of the compartment unit in the access position for retrieving or supplying the replaceable control module, or simply for easy inspection of the control modules.

Also, for gaining easy access to the replaceable control modules accommodated in the compartment unit, at least one of the replaceable control modules may be movably arranged between a storage position and an access position. In the storage position the at least one of the replaceable control module is essentially accommodated inside the storage space of the compartment unit, and in the access position at least one portion of the at least one of the replaceable control module is positioned outside the storage space of the compartment unit.

The invention also comprises a method for controlling subsea operations, wherein the method comprises the following steps:

providing a control room structure from a top side location, providing the control room structure with a fixed modular connection assembly and providing the control room structure with an accommodating unit for receiving and storing a set of replaceable control modules, selecting the set of replaceable control modules in accordance with a chosen subsea operation, wherein at least one of the replaceable control modules is a dedicated control module provided for controlling a corresponding operational well tool, arranging the set of replaceable control modules in the accommodating unit, providing a connection between the set of replaceable control modules and the fixed modular connection assembly for establishing communication between the at least one dedicated control module and its corresponding operational well tool.

In accordance with the method for controlling subsea operations, the step of providing a control room structure from a top side location may be carried out by locating the control room structure at the top side location. The control room structure may then be located top side/close to the water surface, for instance on board a rig or a vessel for carrying out subsea operations.

As such, the method for controlling subsea operations may comprise the following steps:

providing a control room structure from a top side location, providing the control room structure at the top side location with a fixed modular connection assembly and providing the control room structure with an accommodating unit for receiving and storing a set of replaceable control modules, selecting the set of replaceable control modules in accordance with a chosen subsea operation, wherein at least one of the replaceable control modules is a dedicated control module provided for controlling a corresponding operational well tool, arranging the set of replaceable control modules in the accommodating unit, providing a connection between the set of replaceable control modules and the fixed modular connection assembly for establishing communication between the at least one dedicated control module and its corresponding operational well tool.

The inventive modular system is arranged to control various kinds of subsea equipment and operational well tools to be used in subsea operations, such as for instance work over systems. This subsea equipment and the operational well tools subjected to control in accordance with the invention may comprise subsea intervention tools and well access equipment, such as a Christmas Tree (XT), landing string and well control package, and well access equipment to isolate the well from the surroundings in case of emergency, for instance an Emergency disconnect packages (EDP) of a Lower riser package (LRP) solution.

The modular system may be used in various subsea operations, such as tubing hanger installation and retrieval, where the modular system is provided for controlling the landing string or well control package on flowing conditions. Further, tubing hanger installation and retrieval may be employed with a XT Control Skid included in the modular system for controlling a XT without flowing conditions. The modular system may also be used for electrical diagnostics of the XT using the XT Control Skid. Further subsea operations may include well clean up and production-to-flare using a well control package (WCP) or a landing string, as well as wire line or coil tubing operations using a well control package or landing string.

In a further aspect the modular system may be applied for electrical control of a surface flow tree, and also for HPU functions for the surface flow tree, where the supply from rig is set as a default.

By arranging the modular system with control modules that are replaceable, the modular system is suitable for various subsea operations and subsea related operations. The procedure for shifting the modular system from one assemblage specific for controlling a subsea operation to another assemblage suitable for a different subsea operation is simple to carry out. The replaceable control modules necessary for controlling the specific operational well tool or subsea equipment in accordance with the chosen subsea operation are arranged for accommodation in the control room structure. In some circumstances it may be necessary to remove the replaceable control modules present in the control room structure prior to installation of other replaceable control modules. And in other circumstances the replaceable control modules may be moved into the control room structure in addition to the replaceable control modules already occupying the control room structure. The control room structure may of course also be empty, such as when initially installing the replaceable control modules in the control room structure.

In one aspect of the modular system, the dedicated control module included in the selected set of replaceable control modules may comprise a landing string control skid. The landing string control skid may be provided for controlling an operational tool, such as a landing string, and may be used for a tubing hanger mode or a work over mode or other kinds of work over operations.

In another aspect of the dedicated control module, the dedicated control module is provided as a subsea XT controller module provided for controlling a XT (Christmas Tree) and tubing hanger installation and retrieval procedures.

Further, in another aspect, the dedicated control module may also comprise a well control skid provided for controlling a well control package which may be used in a tubing hanger mode and a work over mode.

The set of replaceable control modules may comprise various kinds of control modules necessary for carrying out the chosen subsea operation. In some circumstances one of the replaceable control modules belonging to the selected set of replaceable control modules is a replaceable control center module arranged for accommodation in the control room structure. The replaceable control center module provides an interface for communication with the other replaceable control module(s).

Further, the modular system may in accordance with the invention be provided with a selected set of replaceable control modules to control a well access landing string, such as a Lower Landing String (LLS), subsea test tree (SSTT), high set lubricator valve (HSLV), surface flow tree (SFT), or other subsea equipment necessary for work over operations.

The modular system in accordance with the invention may also be applicable for work over operations such as setting of a horizontal christmas tree in HXT-mode (TRT), setting of production tubing in tubing hanger mode (SLS) and testing of subsea test tree in work over mode (SSTT).

The modular system of the invention can also be used from a vessel for LWI (Light Well Intervention) applications where a more complex system is not needed, e.g., the RLWI (Riserless Light Well Intervention) stack. These operations are typically the logging of a well, communication/function test prior to completion of the well and XT installation.

Further, in another aspect the chosen work over operation may comprise the operation of setting a tubing hanger (SLS) and the selection of the landing string control skid and the subsea XT controller as the two dedicated control modules. The chosen work over operation may also comprise the operation of a testing subsea test tree (SSTT) and the provision of the dedicated control module by the well control skid and the landing string control skid.

By making the control system modular, the extensive task of lifting and handling as necessary when handling conventional control systems is not required. The modular makeup of the control system provides for easy handling and can be changed in a 12 hour shift if needed. The modular system provides for easy access for hookup, testing and maintenance. While omitting the heavy lifting equipment, a large weather window is provided for lifting operations to replace the control modules of the modular control system. The replacement and handling of the control modules may be carried out during rig move operations as well as during drilling operations, and does not interrupt operation plans or execution. Further, the arrangement of the replaceable control units reduces the initial installment and configuration time that is carried out offshore. In fact, the implementation of the modular system with replaceable control modules offers an installation and maintenance time line that is very short compared to the time line of conventional control systems.

Each replaceable control module is provided as a compact unit to be arranged in a control room compartment and arranged so that it may easily be replaced by another control module. This arrangement makes it possible to carry out all heavy maintenance and classification tasks onshore while the operations continue offshore with a replacement control module installed in the control room compartment.

Thus, the makeup of the modular system by replaceable control modules also means that the offshore commissioning time is reduced. The control module which needs attendance can be replaced by another control module while repairing the control module.

The set of compact control modules included in the modular control system offers a reduced size and weight compared to conventional systems. Consequently, there is no need for shallow water lifting of equipment usually required when lifting and handling control systems, for instance for subsea operations such as work over operations. This arrangement provides for flexible handling on the rig and there is no need for modification on the rig itself. The control modules can be supplied to the rig by a vessel and the timeline for relocation of the control modules from onshore to the rig is short.

The modular system provides a versatile solution that is applicable with existing work over control systems (WOCS), and integrates into existing WOCS regardless of the vendor. Further, the modular system is prepared for compatibility with other future work over control systems.

The modular system may be provided with connections with fixed or standardized interfaces, and adaptations are carried out outside the modular system where jumpers will act as adaptive applications. The provision of connections with standardized interfaces facilitates the interchangeability of the replaceable control modules, thus enabling an easy implementation of developments of the control system into the subsea operation control system (for instance a work over control system).

The modular system may be provided to implement and revitalize an existing subsea operation control system to operate on various fields, without major upgrades, and also offers an increased flexibility of operations that can be performed with existing systems.

The hydraulic pressure necessary for communication between the modular system and the operational well tool or the subsea equipment to be controlled may be provided from a hydraulic pressure unit (HPU) provided as a modular entity belonging to the modular system. Alternatively, the hydraulic pressure may be provided by a hydraulic pressure unit of the existing subsea operation control system.

Operator interface of the modular system may be provided independent of the subsea operation control system and may have a dedicated computer system and hardware for support of the computer system. A control station with an operator interface may be provided decentralized from the modular system to provide the possibility of operating the control system from a remote location.

Each of the control modules is provided for controlling subsea operations solely or in combination with other modules depending on the subsea operation to be carried out. The control command is sent from the control module or in interaction with the other control modules.

BRIEF DESCRIPTION OF THE DRAWINGS

In the following, embodiments of the invention will be described in detail with reference to the enclosed drawings, where.

DETAILED DESCRIPTION OF THE INVENTION

Figure 1:
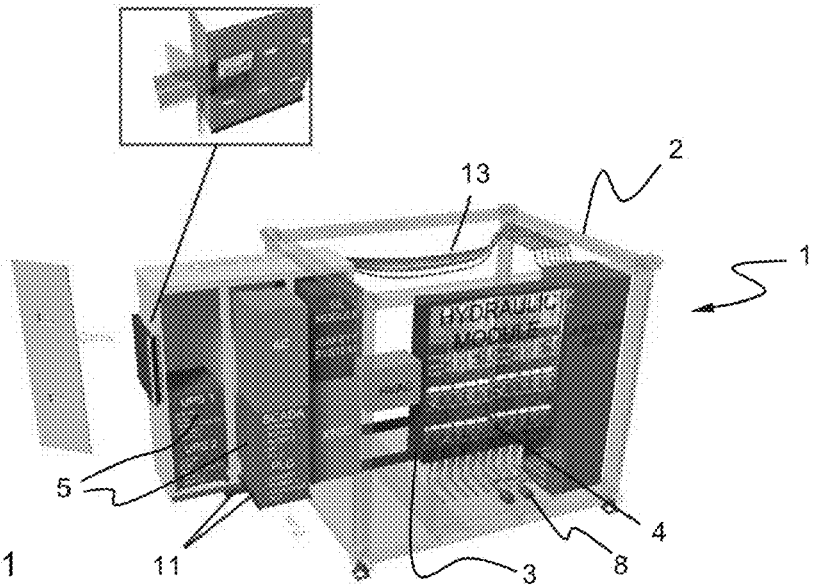
FIGS. 1-5 are principle sketches of the outlay of the modular system in accordance with the invention.

FIGS. 1-5 show the general principles of a modular system 1 for controlling subsea operations. The modular system 1 comprises a control room structure 2 which is shown as a frame structure that may be built as a container-like component (see FIG. 5). The control room structure 2 is provided with a fixed modular connection assembly 3. The fixed modular connection assembly 3 is here shown as a hydraulic module arranged with hydraulic hoses 4 having connector members 8, preferably configured with a standardized interface fitting for a connector of a hose line arranged for communication with an operational well tool (not shown in FIGS. 1-5).

The standardized interface of the connector members 8 ensures that the modular system is compatible with existing circuit lines and can be easily included into existing control systems for subsea operation. The control room structure 2 accommodates a set of replaceable control modules 5. The set of replaceable control modules 5*a*, 5*b*, 5*c*, 5*d*, 5*e* are selected in accordance with the subsea operation to be carried out. In the set of replaceable control modules 5 accommodated in the control room structure there is at least one dedicated control module for controlling a corresponding operational well tool.

The replaceable control modules 5*a*, 5*b*, 5*c*, 5*d*, 5*e* accommodated in the control room structure are connected to the fixed modular connection assembly 3 by means of electrical cables 13 which run from the replaceable control modules 5*a*, 5*b*, 5*c*, 5*d*, 5*e* to a junction box and then to the fixed modular connection assembly 3. By this arrangement the modular system provides for communication between the at least one dedicated control module (or the set of replaceable control modules) and the corresponding operational well tool. In this embodiment communication is carried out using electrical signals within the control room structure and hydraulic pressure signals between the control room structure and the exterior control system which transfers signals to the operational well tool.

FIGS. 1-5 show the set of replaceable control modules 5*a*, 5*b*, 5*c*, 5*d*, 5*e* positioned in storage spaces 7*a*, 7*b*, 7*c* of a compartment unit 6 in accordance with an embodiment of the invention. The compartment unit 6 is shown with the shape of a shelf unit but may of course be provided with a different configuration for the accommodation of the replaceable control units.

The compartment unit 6 is movably arranged in the interior of the control room structure 2. The compartment unit 6 may be arranged with sliding hinges 11 for moving or sliding the compartment unit into and out of the interior of the control room structure 2. The moving of the compartment unit 6 relative to the control room structure 2 may of course be carried out by transfer means other than sliding hinges. For instance, the movable arrangement may be implemented by wheels on rails or other means which preferably ensures a smooth moving of the compartment unit 6.

FIG. 1 shows the compartment unit 6 in an access position where a portion of the compartment unit 6 is located outside the control room structure 2. In this position the replaceable control modules 5*a*, 5*b*, 5*c*, 5*d*, 5*e* of the compartment unit 6 are easy to access for being retrieved and replaced and for depositing a replaceable control module 5*a*, 5*b*, 5*c*, 5*d*, 5*e* in an available space of the compartment unit 6.

Figure 2:
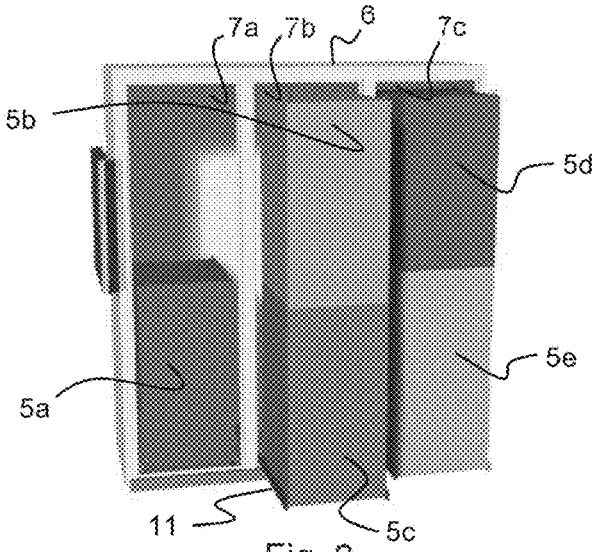
Figure 3:
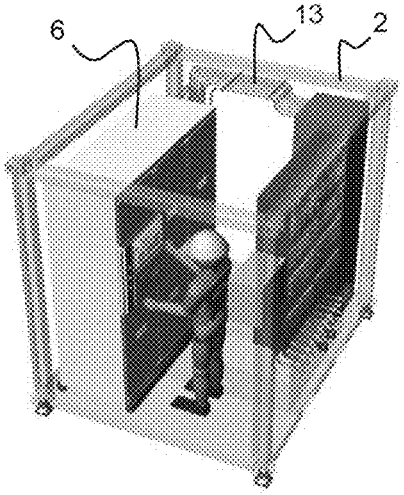
Figure 4:
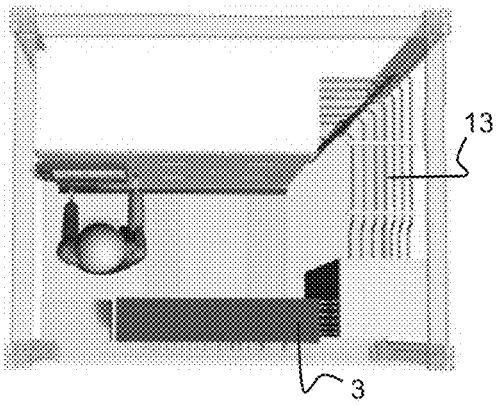
Figure 5:
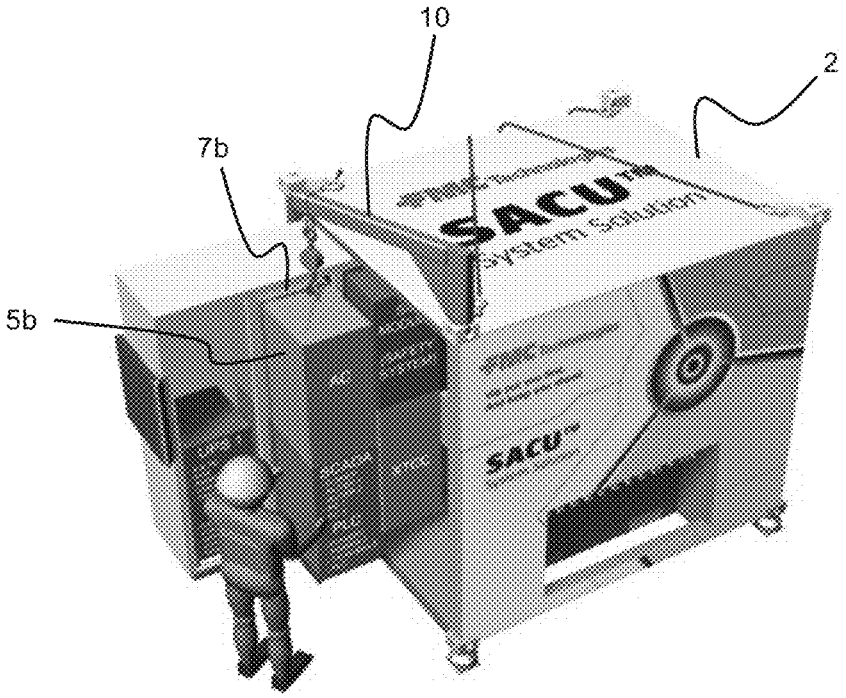

FIGS. 1 and 2 show the replaceable control modules 5*a*, 5*b*, 5*c*, 5*d*, 5*e* arranged in various positions in the storage spaces. The replaceable control module 5*a* is arranged in a storage position inside the storage space 7*a*, whereas the replaceable control modules 5*b*, 5*c* are projecting out from the storage space 7*b* in an access position in which the replaceable control modules 5*b* and 5*c* may be retrieved. FIG. 5 shows the retrieval procedure where the replaceable control module 5*b* is lifted from the accommodated position in storage space 7*b* by means of a crane 10. The replaceable control modules 5*d* and 5*e* are also shown in a position projecting from the storage space 7*c*. In the embodiment of FIGS. 1-5, the replaceable control modules 5*b*, 5*c*, 5*d*, 5*e* are resting on sliding hinges 11, one replaceable control module of top of the other. The sliding hinges 11 facilitate moving the replaceable control modules between a storage position inside the storage room, as illustrated by the position of the replaceable control module 5*a*, and an access position, as illustrated by the positions of the replaceable control modules 5*b*, 5*c*, 5*d*, 5*e*.

As the skilled person will realize, means other than sliding hinges 11 may be provided for moving the replaceable control modules in and out of the storage space. The replaceable control modules may for instance be resting on a base member provided with various configurations, such as a movable structure frame, where the actual moving of the replaceable control modules may be carried out for instance by wheel members. In another embodiment each replaceable control module may be arranged with individual means for moving one replaceable control module at a time.

As seen in FIGS. 1-5 the outlay of the control room structure 2 allows for an operator to enter its interior when the compartment unit 6 is arranged in storage position. The availability of the interior of the compartment unit 6 is also useful when an operator needs to inspect or adjust settings for the modular control system.

Figure 6:
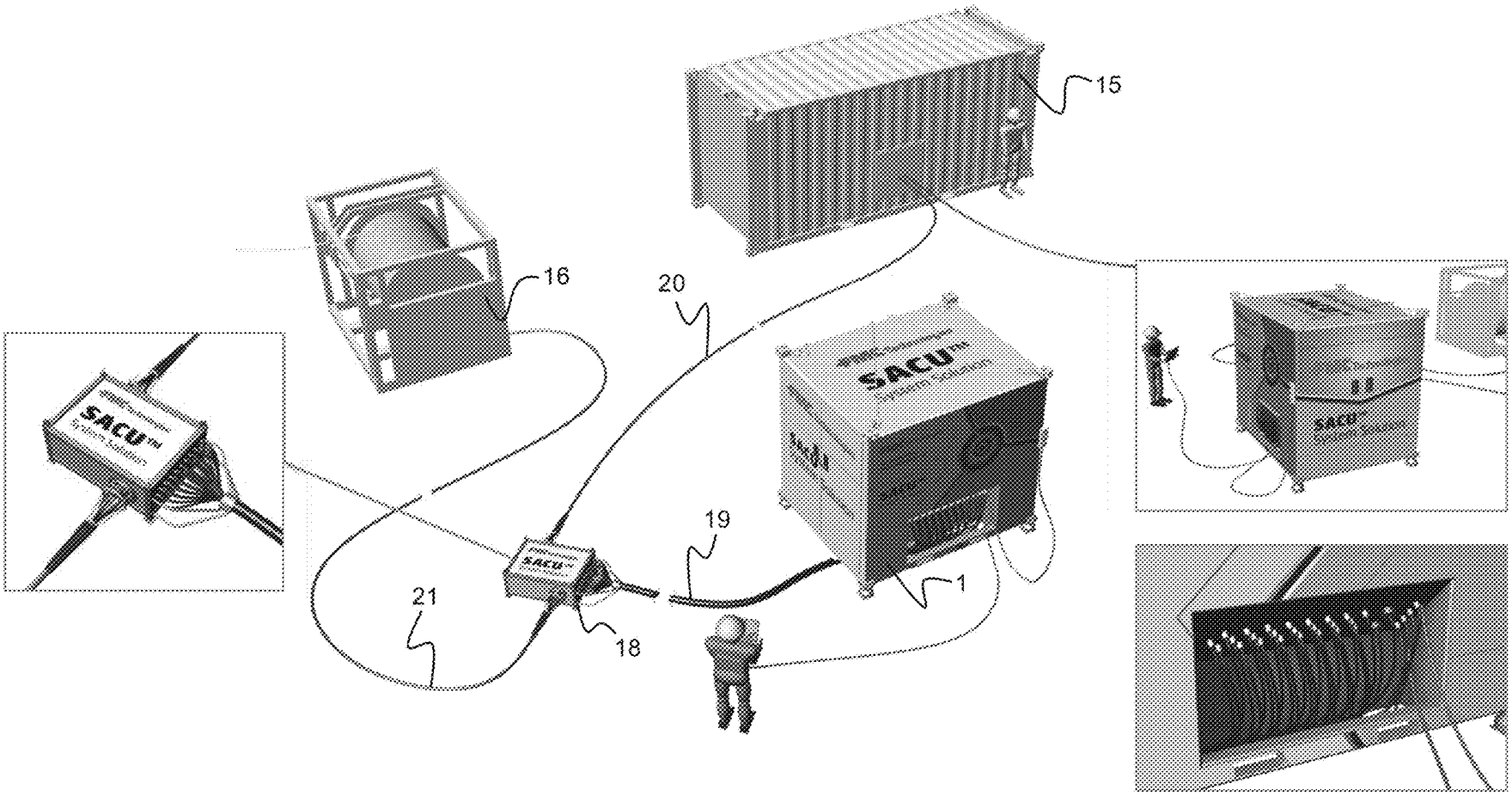
FIG. 6 shows an example of the modular system of FIGS. 1-5 being integrated into an already existing system for controlling subsea operations.

FIG. 6 illustrates an outlay for integration of the modular system 1 in an existing system for work over operations. The modular system 1 communicates with an existing work over control system 15 for the control of various operational well tools. The actual operational tools are not shown in this figure, but a reel 16 for controlling for instance a Christmas Tree (XT) is shown for illustrative purposes. A communication central or junction 18 is provided for interconnecting the signal lines of the modular system 1 and the work over control system 15 and coordinating the signal input from the modular system 1 with the existing work over control system 15 in order to control the reel 16 and thereby the operation of the operational well tool connected to this reel 16.

Figures 8, 9, 10:
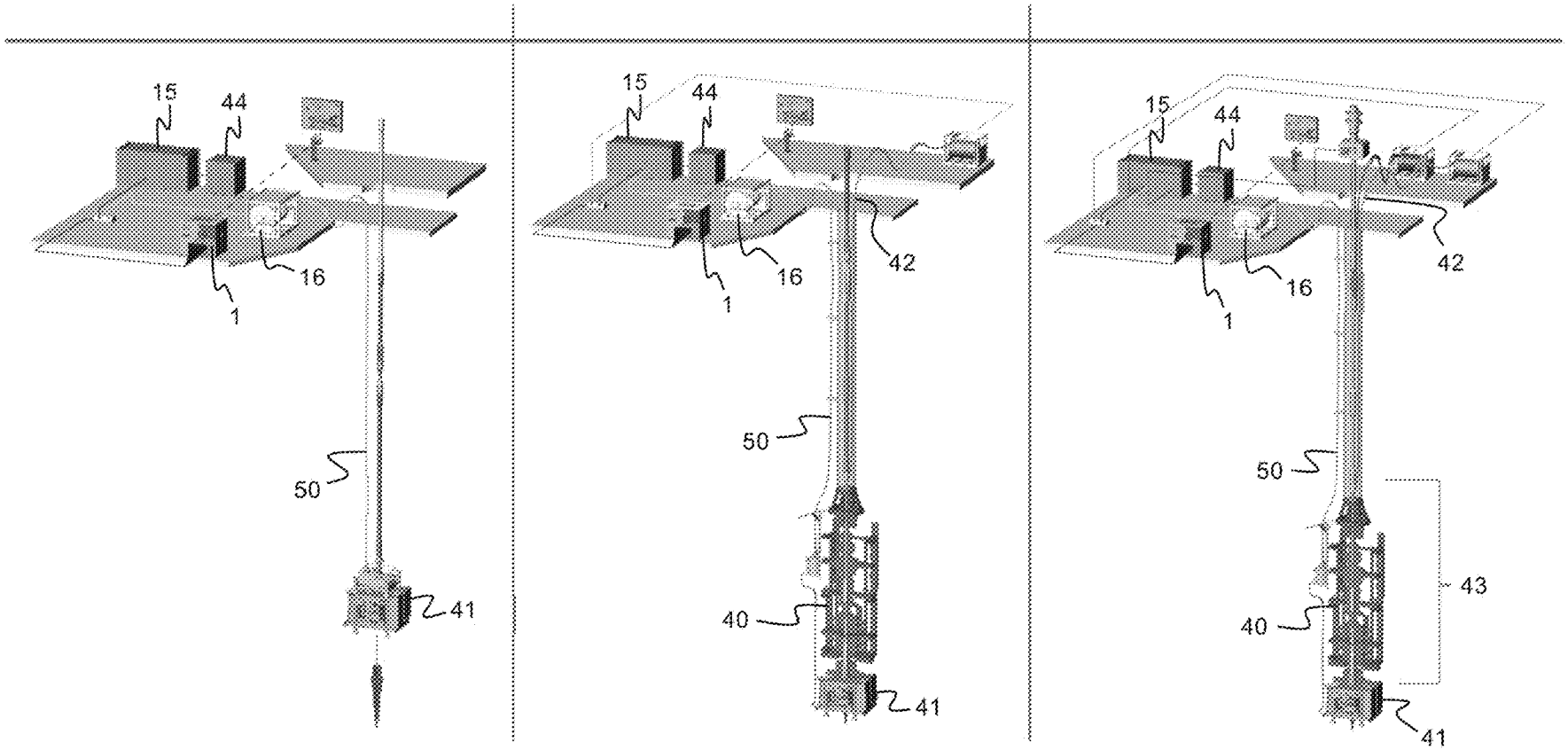
FIGS. 8-10 show examples of outlays as displayed in FIG. 6 for controlling various work over operations.

FIGS. 8, 9 and 10 show examples of three different work over operations where the modular system 1 is implemented for controlling a XT when setting the XT in an HXT-mode (TRT), a landing string for setting the production tubing in a Tubing hanger mode (SLS), and a subsea test tree for testing in the Workover mode (SSTT). These examples of modes of operation will be described in more detail in the following.

The set of replaceable control modules 5*a*, 5*b*, 5*c*, 5*d*, 5*e* as illustrated in FIGS. 1-5 present different functions. One of the control modules, such as the control module 5*a*, may be provided as a UPS module (Uninterrupted Power System), and another control module 5*b* may be provided as an AC module. Further, the control module 5*c* may be provided as an SIL module providing a safety integrity level to the control system. The control module 5*c* may be a SCADA module which is a control center for providing interfaces for communication between the other control modules of the modular system 1. As mentioned above, at least one of the control modules of the set is a dedicated control module for controlling a corresponding operational well tool, such as for instance a XT, a well control package (WCP) and a landing string, and the control module 5*e* is here shown as an illustration of a dedicated control module.

Figure 7:
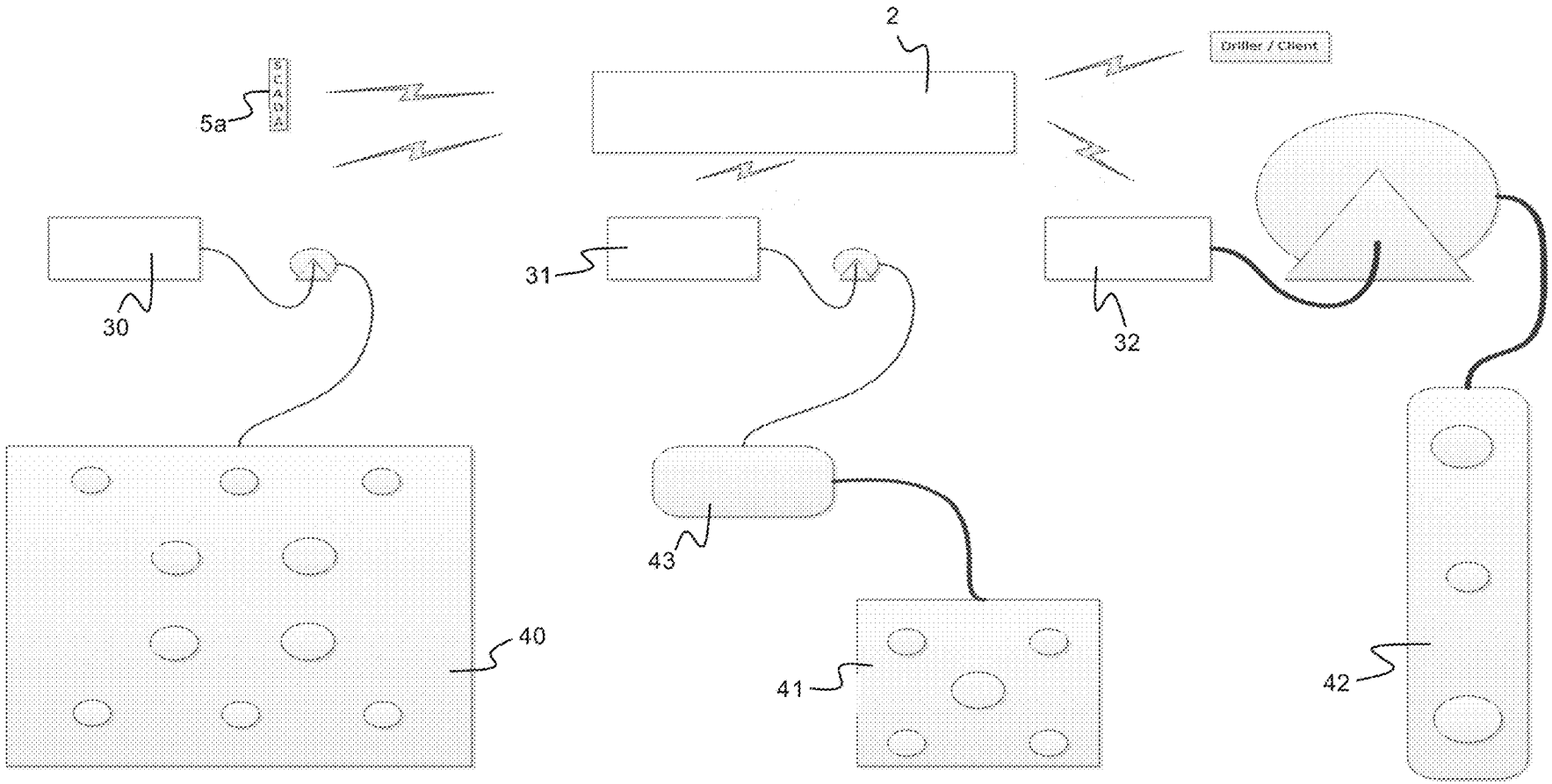
FIG. 7 shows examples of replaceable control modules to be included in the modular system.

FIG. 7 shows examples of the various dedicated control modules for controlling corresponding operational well tools. A Well Control Skid (WSPCU) as represented by box 30 in FIG. 7, the subsea XT Controller (WSPCU XT) as illustrated by box 31 and the Landing string control skid as illustrated by box 32 are all examples of dedicated control modules provided to be accommodated in the control room structure 2 when the corresponding operational well tool is to be employed.

The Well control skid 30 is provided as an independent and self-contained control system for controlling a well control package 40 (WCP). Control valves (not shown) are provided that are non-SIL (safety integrity level) rated for basic process control system. The communication between the Well Control skid 30 and the Well Control Package 40 is carried out as electrical signals or signals communicated by means of an ROV. The Well control skid 30 is arranged independently of existing installation and work over systems and is thus arranged with its own hardware. However, the well control skid 30 is arranged with the possibility to export sensor data to existing work over systems. The Well control skid 30 is provided with standardized interfaces and all communication and integration with existing systems is implemented accordingly.

The Well control skid 30 may be accommodated in the control room structure 2 for controlling the well control package 40 in various subsea operations, such as the tubing hanger mode as shown in FIG. 9 and the work over mode as shown in FIG. 10.

The Subsea XT Controller 31 is provided as an independent and self-contained control system for controlling a XT 41. The XT 41 may be a hydraulic or electro/hydraulic operated XT. The Subsea XT Controller 31 may also control tubing hanger installation/retrieval as shown in FIG. 9. Control valves (not shown) are provided that are non-SIL (safety integrity level) rated to support tubing hanger installations as illustrated in FIG. 9.

The communication between the Subsea XT Controller 31 and the Well Control Package 40 is carried out as electrical signals or signals communicated by means of an ROV. Further, an ROV Bell Skid 43 arranged with an electro/hydraulic controller is illustrated in the line of communication between the Subsea XT Controller 31 and the XT 41. Electrical or ROV-type signals are communicated between the Subsea XT Controller 31 and the ROV Bell Skid 43, whereas electro/hydraulic signals are sent between the ROV Bell Skid 43 and the XT 41. The Subsea XT Controller 31 is arranged independently of existing installation and work over systems and is thus arranged with its own hardware. Electro/Hydraulic connectors use standard interfaces for connection to the Subsea XT Controller 31. Jumpers act as adapters towards the XT. The Subsea XT Controller 31 is provided with standardized interfaces providing for the possibilities of employing different communication technologies and power specifications in terms of voltage, etc.

The Subsea XT Controller 31 may be accommodated in the control room structure 2 for controlling the XT 41 in various subsea operations, such as the setting of the XT 41 in the HXT mode as shown in FIG. 8 and the installation of the production tubing in the tubing hanger mode as shown in FIG. 9.

The landing string control skid 32 is an independent and self-contained control system for controlling a landing string 42 for setting of production tubing (FIG. 9) and testing of the subsea testing tree (SSTT) 43 (FIG. 10) or similar subsea equipment. Control valves (not shown) are provided, both SIL (safety integrity level) rated and non-SIL rated, to support tubing hanger installations as illustrated in FIG. 9, as well as to control the subsea test tree 42 itself (see FIG. 10). The communication between the landing string control skid 32 and the landing string 42 is carried out as electrical/hydraulic signals or other signals. The umbilical system 50 to be used shall contain a minimum of 19 hydraulic lines and is assumed to be CPI (Company provided item). A hydraulic pressure is supplied either from a modular hydraulic pressure unit (HPU) 44 or as unregulated hydraulic pressures from an HPU of the existing workover control system 15. The hydraulic control functions are modular and provided for expansion at a later stage if needed. The landing string control skid 32 is provided with the possibility to export sensor data to existing work over systems. In an emergency shut down operation (ESD) or emergency quick disconnect (EQD), a XT valve cleanup process defined in the XT modes of operation or XT schematics is initiated.

The landing string control skid 32 may be accommodated in the control room structure 2 for controlling the landing string 42 in various subsea operations, such as the tubing hanger mode as shown in FIG. 9 and the work over mode (SSST) as shown in FIG. 10.

In the preceding description, various aspects of the apparatus according to the invention have been described with reference to the illustrative embodiment. For purposes of explanation, specific numbers, systems and configurations were set forth in order to provide a thorough understanding of the apparatus and its workings. However, this description is not intended to be construed in a limiting sense. Various modifications and variations of the illustrative embodiment, as well as other embodiments of the apparatus, which are apparent to persons skilled in the art to which the disclosed subject matter pertains, are deemed to lie within the scope of the present invention as defined in the set of claims.

The invention claimed is:

1. A modular system for controlling subsea operations, comprising:

a control room structure which is positioned at a top side location, the control room structure housing a fixed modular connection assembly;

wherein an interior of the control room structure is configured to accommodate a set of replaceable control modules comprising at least one dedicated control module for controlling a corresponding operational well tool, the operational well tool being configured to perform an operation on a subsea well and the said set of replaceable control modules being selected in accordance with a chosen subsea operation;

wherein the fixed modular connection assembly includes a plurality of connector members which are positioned on an exterior side of the control room structure; and wherein the said set of replaceable control modules is connected to the fixed modular connection assembly and the corresponding operational well tool is connected to a corresponding connector member to thereby establish communication between the at least one dedicated control module and the operational well tool.

2. The modular system for controlling subsea operations in accordance with claim 1, wherein the control room structure comprises a compartment unit having storage space for the set of replaceable control modules.

3. The modular system for controlling subsea operations in accordance with claim 2, wherein the compartment unit is movably arranged in the interior of the control room structure.

4. The modular system for controlling subsea operations in accordance with claim 3, wherein the compartment unit is movable between a storage position in which the compartment unit is positioned inside the control room structure and an access position in which at least a portion of the compartment unit is positioned outside the control room structure.

5. The modular system for controlling subsea operations in accordance with claim 2, wherein at least one of the replaceable control modules is movable between a storage position in which at least one of the replaceable control modules is positioned inside the storage space of the compartment unit and an access position in which at least a portion of the at least one replaceable control modules is positioned outside the storage space of the compartment unit.

6. The modular system for controlling subsea operations in accordance with claim 1, wherein the fixed modular connection assembly comprises at least one connection member having a standardized interface for receiving a connector of at least one line which communicates with at least one of the operational well tools.

7. The modular system for controlling subsea operations in accordance with claim 1, wherein the fixed modular connection assembly comprises a hydraulic module and is configured for receiving signals from the replaceable control modules and transferring the signals as pressure signals to the operational well tools.

8. A method for controlling subsea operations comprising:

providing a control room structure at a top side location;

providing the control room structure with a fixed modular connection assembly and an accommodating unit for receiving and storing a set of replaceable control modules, the fixed modular connection assembly being housed in the control room structure and comprising a plurality of connector members which are positioned on an exterior side of the control room structure;

selecting the set of replaceable control modules in accordance with a chosen subsea operation, wherein at least one of the replaceable control modules is a dedicated control module provided for controlling a corresponding operational well tool which is configured to perform an operation on a subsea well;

arranging the set of replaceable control modules in the accommodating unit; and providing a connection between the set of replaceable control modules and the fixed modular connection assembly and between the operational well tool and a corresponding connector member to thereby establish communication between the at least one dedicated control module and the operational well tool.

* * * * *